US008243966B2

(12) United States Patent
Lin et al.

(10) Patent No.: US 8,243,966 B2
(45) Date of Patent: Aug. 14, 2012

(54) ASSEMBLY STRUCTURE OF A FLAT SPEAKER

(75) Inventors: Yu-Min Lin, Changhua County (TW); Chang-Ho Liou, Changhua County (TW); Yu-Wei Huang, Taichung County (TW); Ming-Daw Chen, Hsinchu (TW); Rong-Shen Lee, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 606 days.

(21) Appl. No.: 12/534,864

(22) Filed: Aug. 4, 2009

(65) Prior Publication Data

US 2010/0158284 A1 Jun. 24, 2010

(30) Foreign Application Priority Data

Dec. 18, 2008 (TW) ..... 97149537 A

(51) Int. Cl.
*H04R 25/00* (2006.01)
*H04R 1/02* (2006.01)

(52) U.S. Cl. ..... 381/191; 381/186; 381/335

(58) Field of Classification Search ..... 381/150, 381/191, 116, 186, 335
See application file for complete search history.

(56) References Cited

U.S. PATENT DOCUMENTS

| | | | | |
|---|---|---|---|---|
| 3,894,199 | A | 7/1975 | Tamura et al. | |
| 7,206,427 | B2 * | 4/2007 | Simidian et al. | 381/335 |
| 2004/0213425 | A1 | 10/2004 | Simidian, II et al. | |

FOREIGN PATENT DOCUMENTS

| | | |
|---|---|---|
| JP | 2008-113288 | 5/2008 |
| TW | 200726300 | 7/2007 |

OTHER PUBLICATIONS

"Office Action of Taiwan Counterpart Application", issued on Oct. 25, 2011, p. 1-p. 5, in which the listed references were cited.

* cited by examiner

*Primary Examiner* — Curtis Kuntz
*Assistant Examiner* — Sunita Joshi
(74) *Attorney, Agent, or Firm* — Jianq Chyun IP Office

(57) ABSTRACT

An assembly structure of flat speaker including at least two speaker units and one connecting structure is provided. Each speaker unit includes a first electrode, a vibrating film, and a second electrode. The connecting structure includes two conductive layers, and a first insulating layer. A first conductive layer is connected the first electrode through a contact area, and each has a first length and a third length parallel to the contact area. A second conductive layer is connected the second electrode through a contact area, and each has a second length and a fourth, a fifth length parallel to the contact area. The third length is less than or equal to a sum of the first lengths of the speaker units. A sum of the third, the fourth, and the fifth length is less than or equal to a sum of the first and second lengths.

45 Claims, 15 Drawing Sheets

ASSEMBLY STRUCTURE OF A FLAT SPEAKER

CROSS-REFERENCE TO RELATED APPLICATION

This application claims the priority benefit of Taiwan application serial no. 97149537, filed on Dec. 18, 2008. The entirety of the above-mentioned patent application is hereby incorporated by reference herein and made a part of specification.

BACKGROUND OF THE INVENTION

1. Field of the Invention

The present invention relates to a structure of a flat speaker. More particularly, the present invention relates to an assembly structure of a flat speaker.

2. Description of Related Art

Two most direct sensory responses of mankind are visual system and hearing system. Therefore, scientists have been dedicated to develop devices or system techniques related to the visual system and the hearing system. Presently, electroacoustic speakers are mainly classified into direct and indirect radiation speakers, and according to driving methods thereof, the speakers are mainly classified into moving-coil, piezoelectric and electrostatic speakers. Whatever the speaker is, main components thereof include electrodes, a vibrating film and chambers.

Presently, the moving-coil speaker is widely used, and a technique thereof is relatively mature. However, a shape thereof is not easy to be flatized due to its structure feature.

Main products of the electrostatic speaker in the market include hi-end earphones and loudspeakers. A functional principle of the conventional electrostatic speaker can be described as follows. A capacitor is formed by clamping a conductive vibrating film with two fixed electrode plates having holes, and by supplying a direct current (DC) bias to the vibrating film and supplying an alternating current (AC) voltage to the two fixed electrodes, the conductive vibrating film is vibrated due to an electrostatic force generated under a positive and a negative electric fields, so as to radiate a sound. The bias of the conventional electrostatic speaker has to reach hundreds to thousands voltages, and therefore an external amplifier with high price and great size has to be applied.

Regarding the electrostatic speaker, a U.S. Pat. No. 3,894,199 discloses an electroacoustic transducer structure shown as FIG. 1, which includes fixed electrodes 110 and 120 disposed at two sides. The fixed electrodes 110 and 120 have a plurality of holes used for distributing sounds. A vibrating film 130 is disposed between the fixed electrodes 110 and 120. A fixing structure 140 is formed by an insulating material and is used for fixing the fixed electrodes 110 and 120 and the vibrating film 130. The fixed electrodes 110 and 120 are respectively connected to an AC voltage source 160 through a transformer 150. When AC signals are transmitted to the fixed electrodes 110 and 120, potentials thereof are alternately changed, and the vibrating film 130 is vibrated due to a potential difference at the two sides, so as to generate a corresponding sound.

According to the above configuration, a sound pressure output has to be enhanced, so that an extra power device has to be applied, which can lead to a great size of the device.

SUMMARY OF THE INVENTION

Embodiments disclosed herein may provide an assembly structure of flat speaker. The assembly structure of flat speaker including at least two speaker units and one connecting structure. Each speaker unit includes a first electrode, a vibrating film, and a second electrode, wherein the vibrating film is stacked on the second electrode, and is located between the first electrode and the second electrode. The connecting structure includes a first conductive layer, a second conductive layer, and a first insulating layer. The first conductive layer is electrically connected to the first electrodes through a contact area, wherein the first electrode on the contact area has a first length parallel to the contact area, and the first conductive layer on the contact area has a third length parallel to the contact area. The second conductive layer is electrically connected to the second electrodes through a contact area, wherein the second electrode on the contact area has a second length parallel to the contact area, and the second conductive layer on the contact area has a fourth length and a fifth length respectively parallel to the contact area. The fourth and fifth lengths are less than or equal to the second length. The first insulating layer is disposed between the first conductive layer and the second conductive layer. When the speaker units are assembled through the connecting structure, the third length is less than or equal to a sum of the first lengths, and a sum of the third length, the fourth length, and the fifth length is less than or equal to a sum of the first lengths and the second lengths.

Embodiments disclosed herein may provide another assembly structure of flat speaker. The assembly structure of flat speaker including at least one speaker unit and one connecting structure. The speaker unit includes a first electrode, a vibrating film, and a second electrode, wherein the vibrating film is stacked on the second electrode, and is located between the first electrode and the second electrode. The connecting structure is used to assemble the speaker unit, and includes a first conductive layer, a second conductive layer, and a first insulating layer. The first conductive layer is electrically connected to the first electrode through a contact area, wherein the first electrode on the contact area has a first length parallel to the contact area, and the first conductive layer on the contact area has a third length parallel to the contact area, wherein the third length is less than or equal to the first length. The second conductive layer is electrically connected to the second electrode through a contact area, wherein the second electrode on the contact area has a second length parallel to the contact area, and the second conductive layer on the contact area has a fourth length parallel to the contact area, wherein the fourth length is less than or equal to the second length. The first insulating layer is disposed between the first conductive layer and the second conductive layer. When the speaker unit is assembled through the connecting structure, a sum of the third length and the fourth length is less than or equal to a sum of the first length and the second length.

Embodiments disclosed herein may provide still another assembly structure of flat speaker. The assembly structure of flat speaker including at least two speaker units and one connecting structure. The speaker unit includes a first electrode, a vibrating film, a second electrode and an edge frame supporter, wherein the vibrating film is stacked on the second electrode, and is located between the first electrode and the second electrode, the edge frame supporter is disposed around the speaker unit, and is used for supporting the speaker unit and forming an outline of the speaker unit. The connecting structure is used for assembling the speaker units, and includes a first conductive layer, a second conductive layer, and a first insulating layer. The first conductive layer is electrically connected to the first electrodes through a contact area, wherein the first electrode on the contact area has a first length parallel to the contact area, and the first conductive layer on the contact area has a third length parallel to the contact area. The second conductive layer is electrically connected to the second electrodes through a contact area, wherein the second electrode on the contact area has a second length parallel to the contact area, and the second conductive layer on the contact area has a fourth length and a fifth length respectively parallel to the contact area. The fourth and fifth lengths are respectively less than or equal to the second length. The first insulating layer is disposed between the first conductive layer and the second conductive layer. When the speaker units are assembled through the connecting structure, the third length is less than or equal to a sum of the first lengths, and a sum of the third length, the fourth length, and the fifth length is less than or equal to a sum of the first lengths and the second lengths.

In order to make the aforementioned and other objects, features and advantages of the present invention comprehensible, a embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
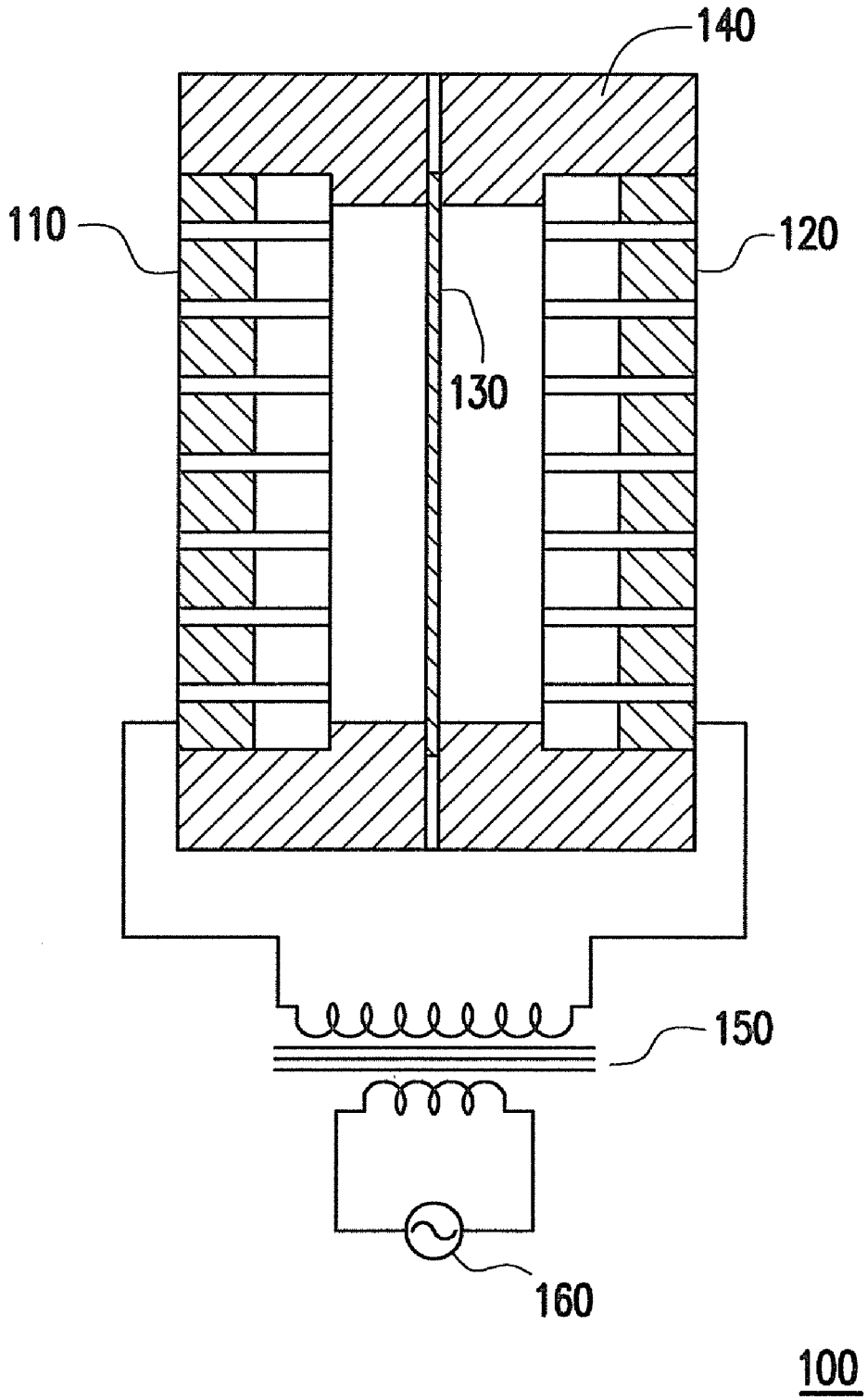
FIG. 1 (PRIOR ART)
FIG. 1 is a schematic diagram illustrating a conventional speaker unit.
Figure 2A:
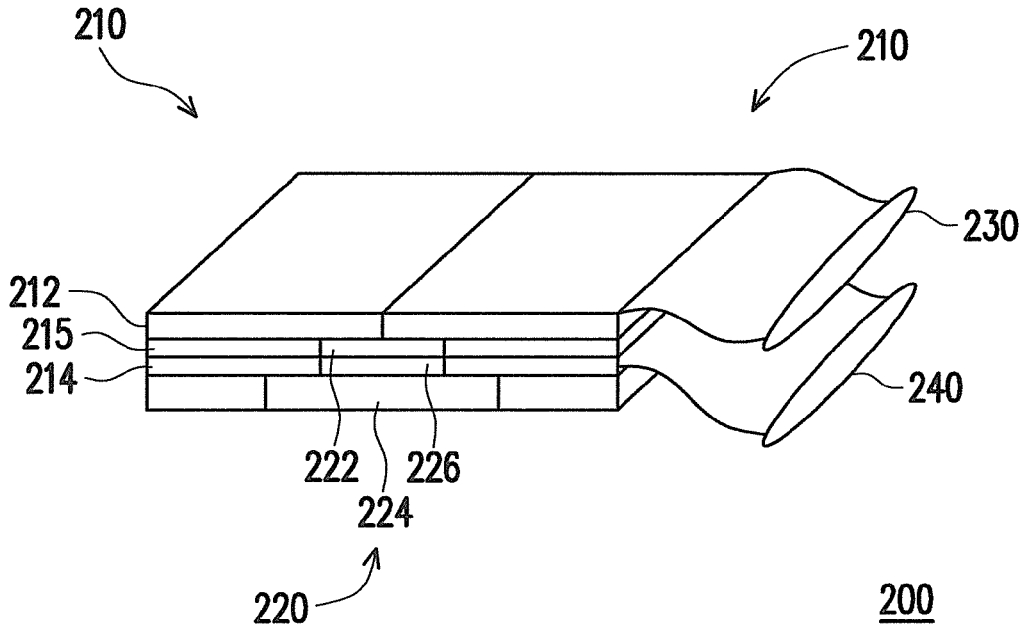
FIG. 2A is a schematic diagram illustrating an assembly structure of flat speaker according to an embodiment of the present invention.
Figure 2B:
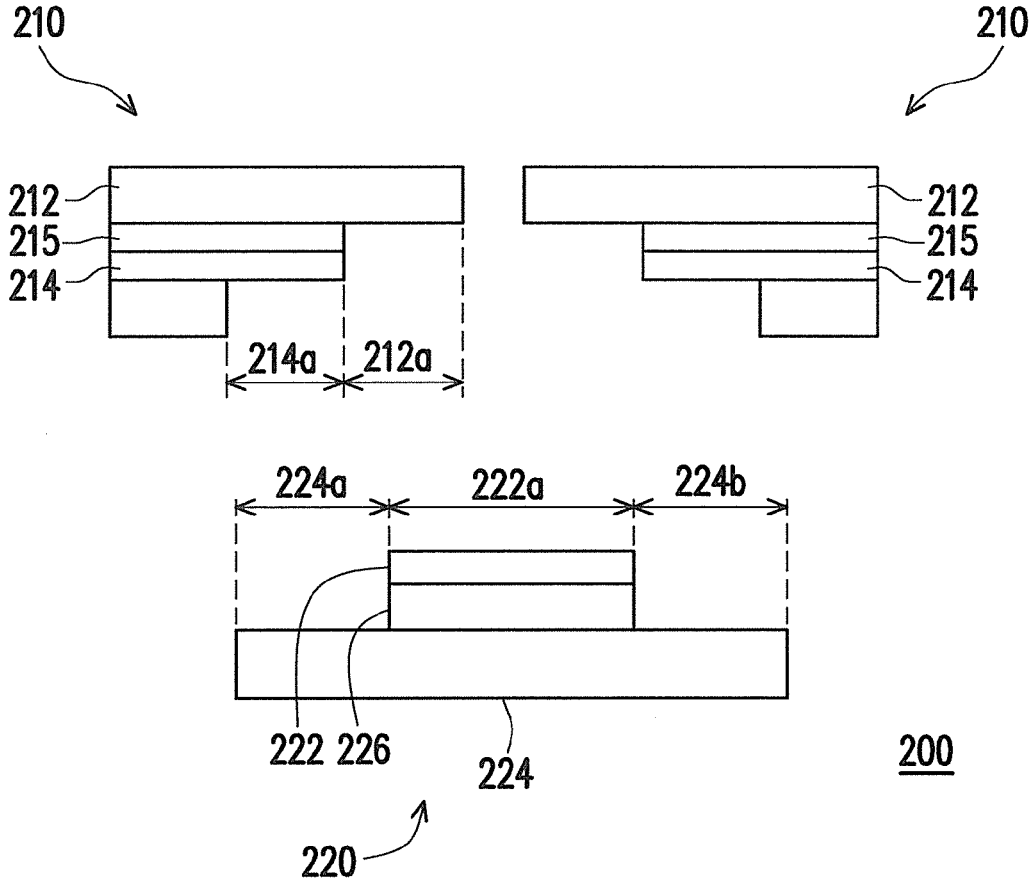
FIG. 2B is a cross-sectional exploded view of an assembly structure of flat speaker of FIG. 2A along an electrical conduction direction.

FIG. 2A is a schematic diagram illustrating an assembly structure of a flat speaker according to an embodiment of the present invention. FIG. 2B is a cross-sectional exploded view of the assembly structure of a flat speaker of FIG. 2A along an electrical conduction direction. Referring to FIG. 2A and FIG. 2B, the assembly structure 200 includes two speaker units 210 and a connecting structure 220. Each of the speaker units 210 includes a first electrode 212, a second electrode 214 and a vibrating film 215, wherein the vibrating film 215 is stacked on the second electrode 214, and is located between the first electrode 212 and the second electrode 214. The connecting structure 220 includes a first conductive layer 222, a second conductive layer 224, and a first insulating layer 226, wherein the first insulating layer 226 is disposed between the first conductive layer 222 and the second conductive layer 224.

When the two speaker units 210 are assembled through the connecting structure 220, the first conductive layer 222 is electrically connected to the first electrodes 212 of the two speaker units 210 through a contact area, wherein the first electrode 212 on the contact area has a first length 212*a* parallel to the contact area. Moreover the first conductive layer 222 on the contact area has a third length 222*a* parallel to the contact area, and the third length 222*a* is less than or equal to a sum of the first lengths 212*a* of the two speaker units 210.

On the other hand, the second conductive layer 224 is electrically connected to the second electrodes 214 of the two speak units 210 through a contact area, wherein the second electrode 214 on the contact area has a second length 214*a* parallel to the contact area. Moreover, the second conductive layer 224 on the contact area has a fourth length 224*a* and a fifth length 224*b* respectively parallel to the contact area, and a sum of the third length 222*a*, the fourth length 224*a*, and the fifth length 224*b* is less than or equal to a sum of the first lengths 212*a* and the second lengths 214*a* of the two speaker units 210.

In other words, the contact area of the connecting structure 220 is less than or equal to the contact areas of the first electrode 212 and the second electrode 214, which means that the connecting structure 220 can be adjusted according to a size of the contact areas of the first electrode 212 and the second electrode 214, so that the connecting structure 220 can match a requirement of an appearance size of the speaker units 210, which avails to configure the connecting structure 220 according to the appearance size and a quantity of the speaker units 210.

Figure 2C:
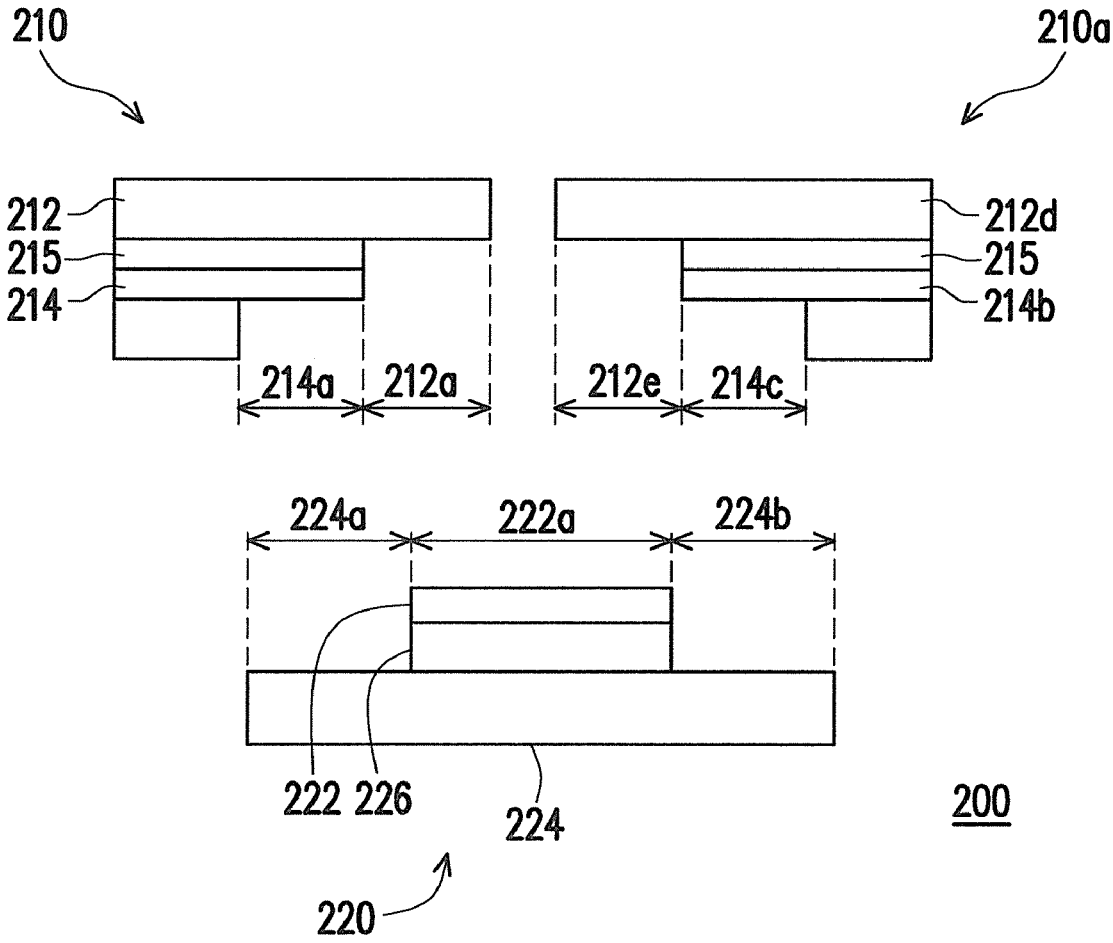
FIG. 2C is a cross-sectional exploded view of an assembly structure of flat speaker along an electrical conduction direction according to another embodiment of the present invention.

FIG. 2C is a cross-sectional exploded view of an assembly structure of a flat speaker along an electrical conduction direction according to another embodiment of the present invention. In the present invention, in the two speaker units 210 and 210*a*, the first lengths 212*a* and 212*e* of the first electrodes 212 and 212*d* can be mutually different, and the second lengths 214*a* and 214*c* of the second electrodes 214 and 214*b* can also be mutually different. In other words, the two speaker units 210 and 210*a* of the present embodiment can be asymmetric. Though, by adjusting the lengths of the first conductive layer 222 and the second conductive layer 224 on the connecting structure 220, the two asymmetric speaker units 210 and 210*a* can still be connected. Therefore, the appearances and sizes of the speaker units 210 and the connecting structure 220 in the assembly structure 200 are not limited by the present invention, and based on matching variations between the speaker units 210 and the connecting structure 220, the assembly structure 200 may have diversified appearances.

In the present embodiment, the assembly structure 200 further includes at least two signal input sources 230 and 240 electrically connected to the first electrode 212 and the second electrode 214, respectively, so as to input source signals to the speaker units 210. In another embodiment that is not illustrated, the signal input sources 230 and 240 can be electrically connected to the first conductive layer 222 and the second conductive layer 224, respectively, so that the source signals can be simultaneously input to the speaker units 210 through the connecting structure 220.

On the other hand, the speaker units 210 are electrically connected to the connecting structure 220 through the contact area, so that currents can be transmitted in a flat approach. Compared to a conventional point contact or welding contact, the assembly structure 200 can provide a more stable source signal.

Figure 3:
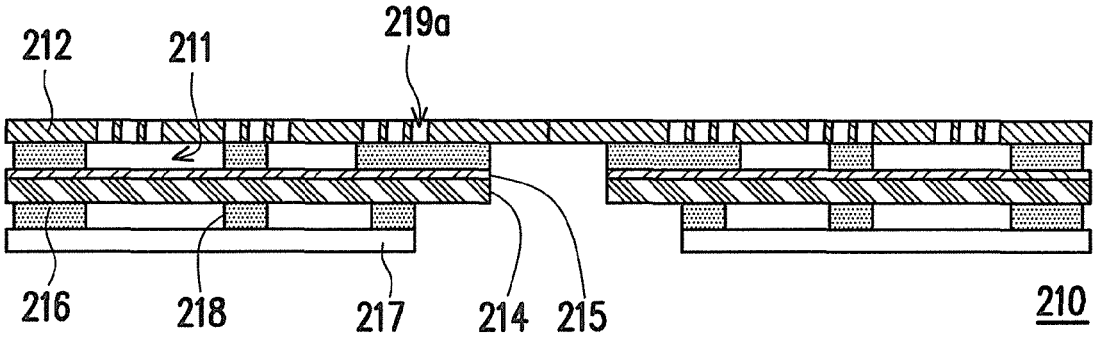
FIG. 3 is a diagram illustrating a detailed structure of a speaker unit of FIG. 2A.

FIG. 3 is a diagram illustrating a detailed structure of the speaker unit of FIG. 2A. Referring to FIG. 3, in the present embodiment, the first electrode 212 has a plurality of holes 219*a* for distributing sounds generated by the speaker unit 210. The first electrode 212 can be fabricated by a metal material layer, such as iron, copper, aluminium, etc. or alloys thereof. Here, the first electrode 212 can also have stripes (not shown) on its surface to gain a distribution effect of the sounds generated by the speaker unit 210. Moreover, the speaker unit 210 further includes a chamber substrate 217 located on the second electrode 214 at a side apart from the vibrating film 215.

In the present embodiment, the vibrating film 215 is formed by material having a charge-maintaining characteristic, for example, electret materials or a dielectric material. The dielectric material can maintain static charges for a long time after being electrized, and after the dielectric material is charged, a charge-maintaining effect can be achieved in internal of the material.

The vibrating film 215 can be fabricated by a single-layer or a multi-layer dielectric material, and the dielectric material can be, for example, fluorinated ethylenepropylene (FEP), polytetrafluoethylene (PTFE), polyvinylidene fluride (PVDF), a part of fluorine polymers or other suitable materials, etc. Such dielectric material includes holes of micrometer size or nano-micro meter size in internal thereof. Since the vibrating film 215 can maintain static charges and a piezoelectricity for a long time after the dielectric material thereof is electrized, and the internal of the vibrating film 215 may contain the nano-micro meter holes to increase a transmittance and the piezoelectricity thereof, dipolar charges are generated in the internal of the material after a corona charging, so as to achieve the charge-maintaining effect.

Moreover, the second electrode 214 can be a very thin metal thin-film electrode to avoid influencing a tension and vibration effect of the vibrating film 215.

Here, the vibrating film 215 fully filled with negative charges is taken as an example. When the source signals are respectively input to the first electrode 212 and the second electrode 214, one of the source signals has a positive voltage, which may attract the negative charges of the vibrating film 215, and another one of the source signals has a negative voltage, which may repulse the negative charges of the vibrating film 215, so that a movement of the vibrating film 215 is generated.

Conversely, when voltage phases of the source signals are changed, since one of the source signals has the positive voltage and attracts the negative charges of the vibrating film 215, and another one of the source signals has the negative voltage and repulses the negative charges of the vibrating film 215, a movement direction of the vibrating film 215 is reversed. When the vibrating film 215 is vibrated in different directions, alternatively caused by the repulsive force or the attractive force, sounds are generated and output due to compression of the peripheral air.

On the other hand, the speaker unit 210 further includes an edge frame supporter 216 and a plurality of supporters 218. The edge frame supporter 216 is disposed between the first electrode 212 and the chamber substrate 217, and is used for forming a space to facilitate vibration of the vibrating film 215. The plurality of supporters 218 disposed between the chamber substrate 217 and the first electrode 212 supports a distance between the second electrode 214 and the first electrode 212 to form a plurality of working areas, i.e. chamber spaces 211 of the speaker unit 210 user for generating a resonance sound field. Regardless of the edge frame supporter 216 or the supporters 218, an allocation method and a height thereof can be adjusted according different design requirements. Moreover, a quantity of the edge frame supporters 216 can be designed to be equal to, less than or greater than that of the supporters 218. In addition, the supporters 218 or the edge frame supporter 216 can be respectively fabricated on the second electrode 215 or the chamber substrate 217.

Figure 4:
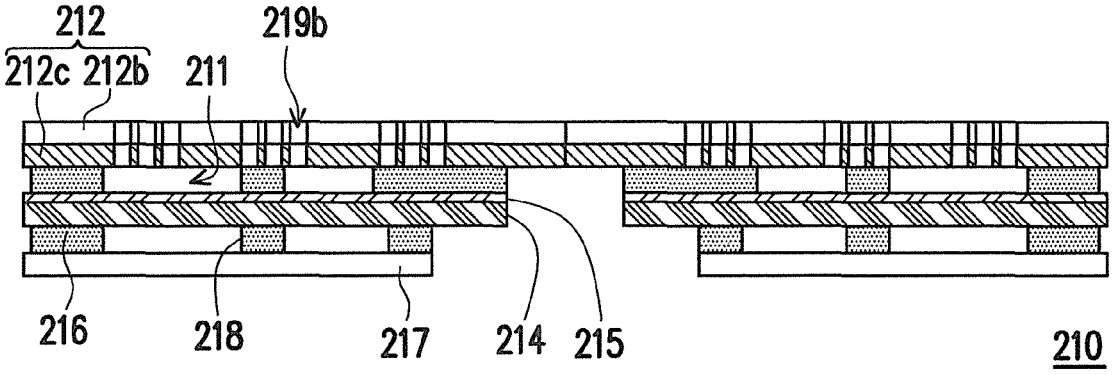
FIG. 4 is a schematic diagram illustrating a detailed structure of a speaker unit according to another embodiment of the present invention.

FIG. 4 is a schematic diagram illustrating a detailed structure of a speaker unit according to another embodiment of the present invention. Different to the aforementioned embodiment, the first electrode 212 of the speaker unit 210 can be formed by a non-conductive layer 212*b* plated with a conductive thin-film 212*c*. The non-conductive layer 212*b* can be a non-conductive material such as plastic, rubber, paper, or non-conductive cloth (such as cotton fiber and polymer fiber) etc., and the conductive thin-film 212*c* can be a pure metal material such as aluminium, aurum, argentum, copper, etc., or alloys thereof, a bimetallic material such as Ni/Au, one of indium tin oxide (ITO) or indium zinc oxide (IZO) or a combination thereof, or a conductive polymer material such as poly ethylenedioxythiophene (PEDOT), etc. Moreover, the non-conductive layer 212*b* of the first electrode 212 may include a plurality of holes 219*b* and stripes (not shown), wherein the holes 219*b* are used for distributing the sounds generated by the speaker unit 210, and the stripes are used for gaining a distribution effect of the sounds distributed by the holes 219*b*. Here, formations of the holes 219*b* and the stripes are not limited by the present invention.

Figure 5:
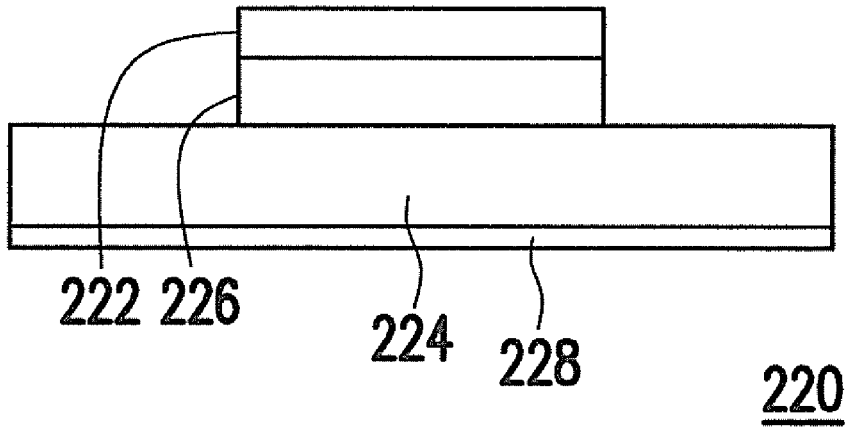
FIG. 5 is a schematic diagram illustrating a structure of a connecting structure according to another embodiment of the present invention.

FIG. 5 is a schematic diagram illustrating a connecting structure according to another embodiment of the present invention. Referring to FIG. 5, in the present embodiment, the connecting structure 220 further includes a second insulating layer 228 disposed on a surface apart from the first insulating layer 226. The second insulating layer 228 has a function of adjusting a height of the connecting structure 220, so that the connecting structure 220 can match an assembly height of the speaker units 210.

Figure 6:
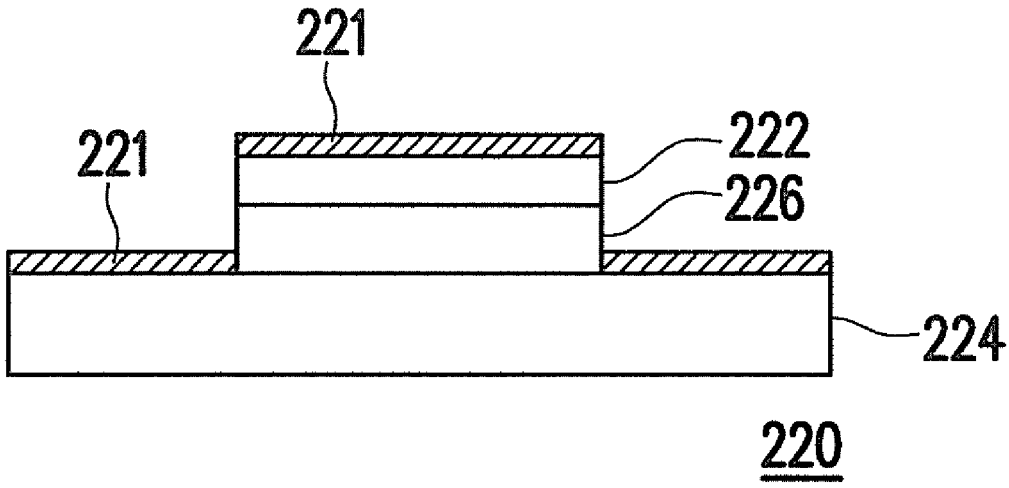
FIG. 6 is a schematic diagram illustrating a structure of a connecting structure according to another embodiment of the present invention.

FIG. 6 is a schematic diagram illustrating a connecting structure according to another embodiment of the present invention. Referring to FIG. 6, in the present embodiment, the connecting structure 220 further includes a conductive adhesive material 221 such as a conductive adhesive, an anisotropic conductive adhesive or an isotropic conductive adhesive, etc. disposed on the surfaces of the first conductive layer 222 and the second conductive layer 224, which is used for attaching and electrically connecting the first electrode 212 and the second electrode 214.

Figure 7:
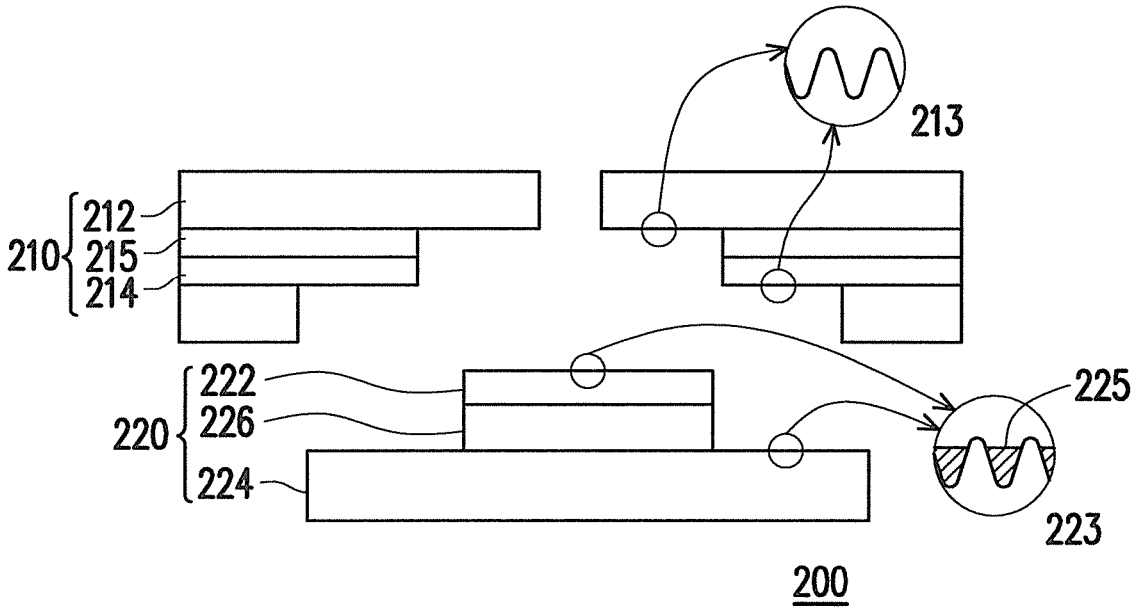
FIG. 7 is a schematic diagram illustrating a structure of a connecting structure according to another embodiment of the present invention.

FIG. 7 is a schematic diagram illustrating a structure of a connecting structure according to another embodiment of the present invention. Referring to FIG. 7, in the present embodiment, the contact areas between the speaker units 210 and the connecting structure 220 respectively have uneven structures 214 and 223. Moreover, the connecting structure 220 further includes a non-conductive adhesive material 225, for example, an ultraviolet adhesive or an insulating adhesive. Based on a shrinking or curing characteristic of the non-conductive adhesive material 225 due to chemical reactions (for example, the non-conductive adhesive material 225 is cured after being heated or being radiated by the ultraviolet), protrusion parts of the uneven structures 213 and 223 are electrically connected.

Figure 8:
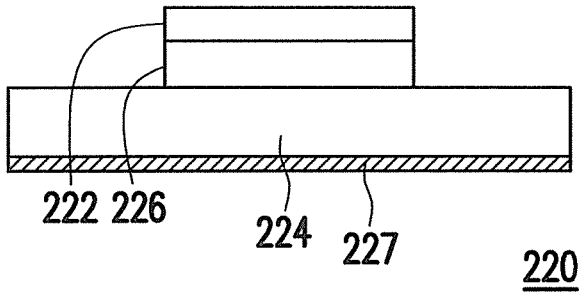
FIG. 8 is a schematic diagram illustrating a structure of a connecting structure according to another embodiment of the present invention.

FIG. 8 is a schematic diagram illustrating a structure of a connecting structure according to another embodiment of the present invention. Referring to FIG. 8, in the present embodiment, the connecting structure 220 further includes an adhesive material 227 disposed on a surface of the connecting structure 220 apart from the speaker unit 210. When the speaker unit 210 is assembled, the connecting structure 220 can be first attached to a surface of another object, and then the speaker unit 210 is attached to the connecting structure 220.

Referring to FIG. 2A again, in the present embodiment, the first insulating layer 226 can also be fabricated by polymer, so that the connecting structure 220 may have a flexible characteristic, so as to match the speaker units 210 with different shapes or located at different positions.

Figure 9A:
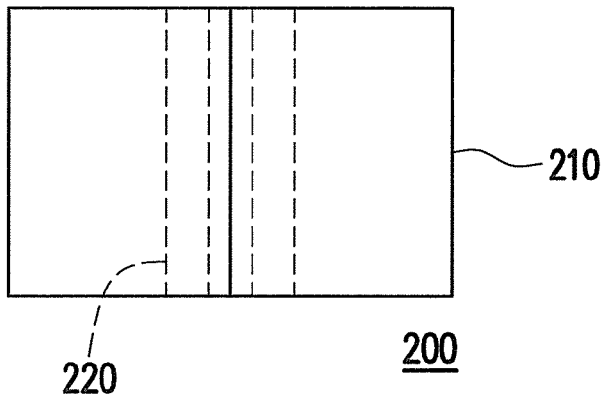
FIG. 9A is a top view of an assembly structure of flat speaker of FIG. 2A.
Figure 9B:
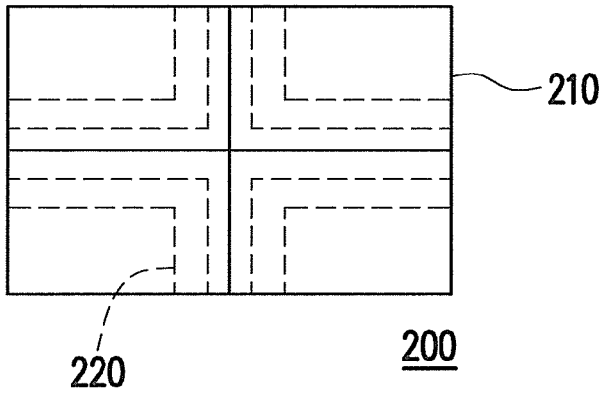
FIG. 9B to FIG. 9G are top views of speaker units with different shapes and corresponding connecting structures matching the same.

FIG. 9A is a top view of the assembly structure of FIG. 2A. In the present embodiment, the connecting structure 220 has a long-bar shape suitable for connecting two long-bar-shape speaker units 210. Moreover, a corresponding connecting structure 220 can be selected according to a different shape of the speaker unit 210, so as to achieve diversified appearance variations of the assembly structure 200. FIG. 9B to FIG. 9G are top views of the speaker units with different shapes and the corresponding connecting structures matching the same. Referring to FIG. 9B, in the present embodiment, if the speaker units 210 have a block shape, the connecting structure may have a cross shape, which can simultaneously connect four speaker units. Moreover, the connecting structure 220 can also be varied to have a turning shape to match the speaker units 210 with different shapes and different quantities.

Figure 9C:
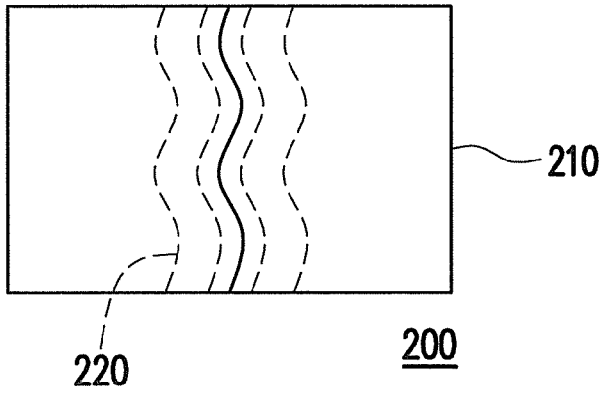
Figure 9D:
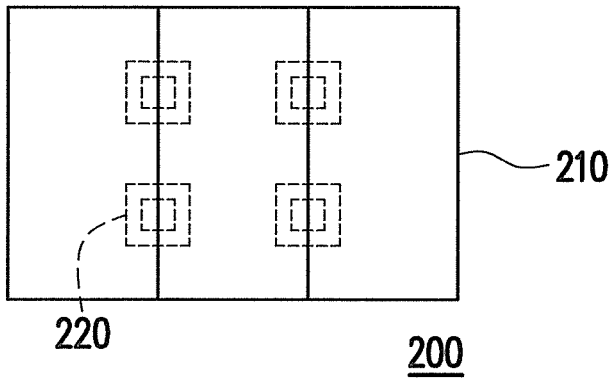
Figure 9E:
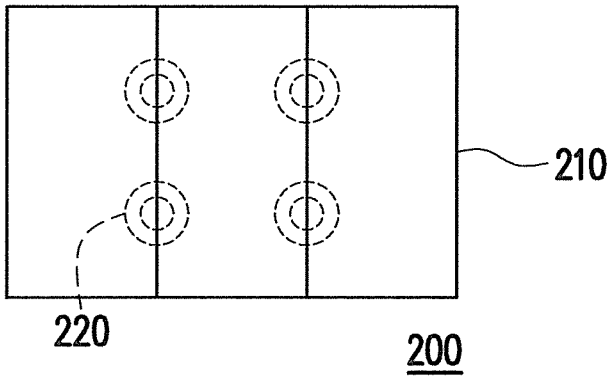
Figure 9F:
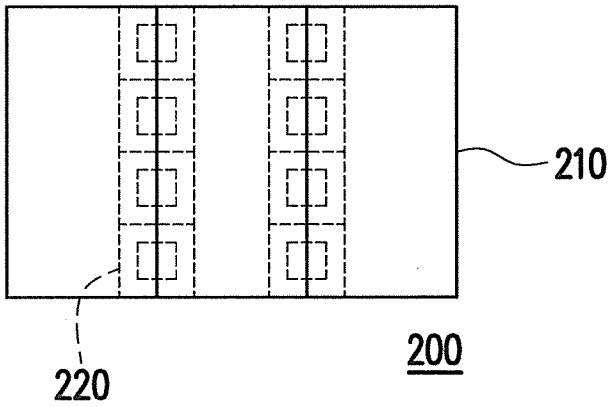
Figure 9G:
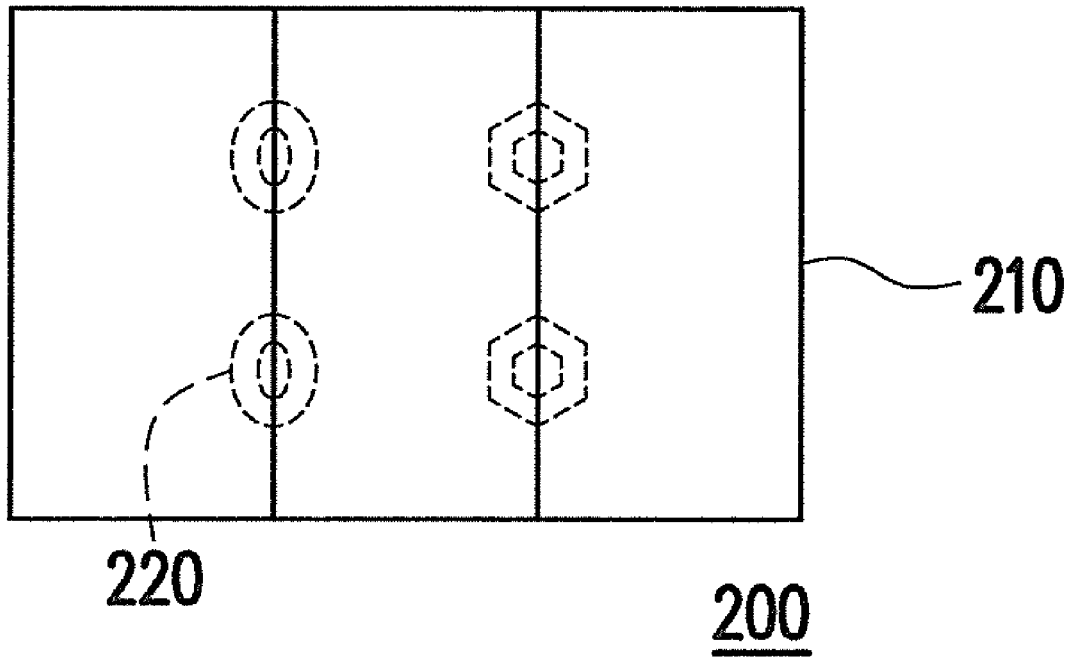

Referring to FIG. 9C, the connecting structure 220 may have a shape of dentations or an irregular curve to match the speaker units 210 having different shapes, so as to achieve a novel and elegant appearance effect of the assembly structure 200. Referring to FIG. 9D to FIG. 9G, the connecting structures 220 may have shapes of rectangular, circle or other shapes to connect the speaker units 210 having the corresponding shapes. Moreover, the shape of the connecting structure 220 can also be a combination of the aforementioned shapes, so that a selectivity and diversity for assembling the assembly structure 200 can be improved. Moreover, a quantity of the connecting structure 220 can also be increased for increasing an electrical conduction effect thereof. Shape matching of the speaker units 210 and the connecting structure 220 are described in the aforementioned embodiments, though the shapes and quantities of the speaker units 210 and the connecting structures 220 are not limited by the present invention.

Figure 11A:
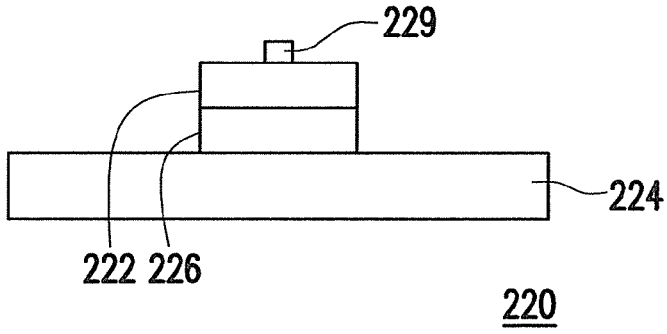
FIG. 11A is a schematic diagram illustrating a structure of a connecting structure according to another embodiment of the present invention.
Figure 11B:
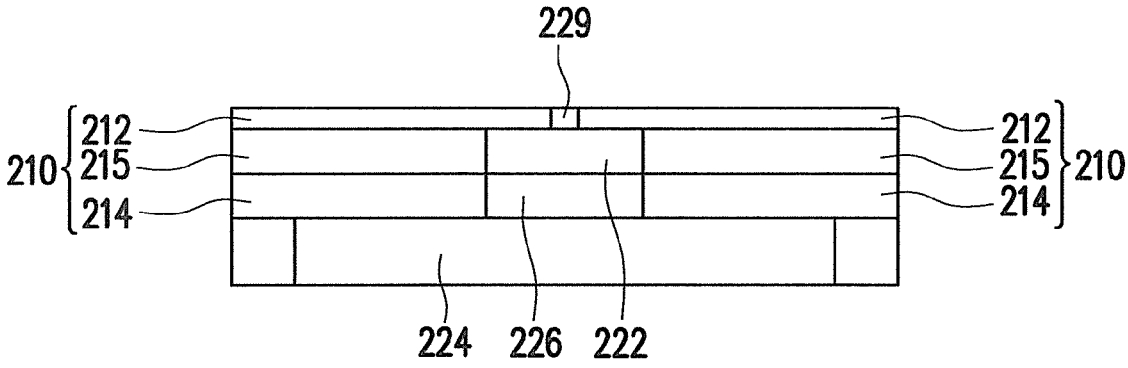
FIG. 11B is a schematic diagram illustrating a combination of a connecting structure of FIG. 11A and speaker units.

FIG. 11A is a schematic diagram illustrating a structure of a connecting structure according to another embodiment of the present invention. FIG. 11B is a schematic diagram illustrating a combination of the connecting structure of FIG. 11A and the speaker units. Referring to FIG. 11A and FIG. 11B, a difference between the present embodiment and the aforementioned embodiment is that the connecting structure 220 further has a second protrusion 229 stacked on the first conductive layer 222 for connecting the first electrode 212. In the present embodiment, due to an assembly or an appearance requirement of the speaker units 210, a fissure is existed between the first electrodes 212. Considering an aesthetics after the speaker units 210 is assembled, the second protrusion 229 is additionally added to the connecting structure 220, so as to fill up the fissure between the first electrodes 212. In the present embodiment, the second protrusion 229 can be an insulating material for filling up the fissure between the first electrodes 212. Moreover, the second protrusion 229 can also be a conductive material for increasing an electrical connecting effect between the connecting structure 220 and the first electrodes 212.

Figure 11C:
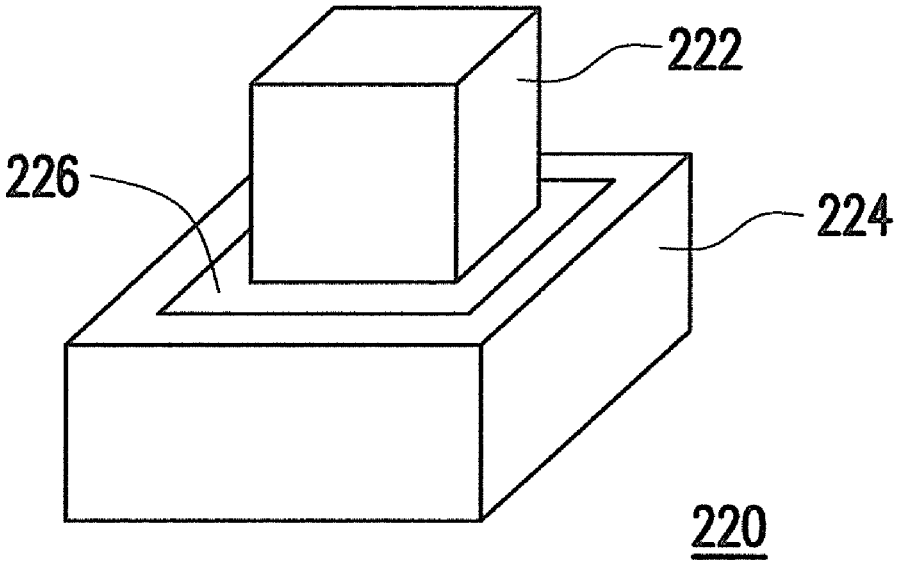
FIG. 11C and FIG. 11D are schematic diagrams illustrating a structure of a connecting structure according to another embodiment of the present invention.
Figure 11D:
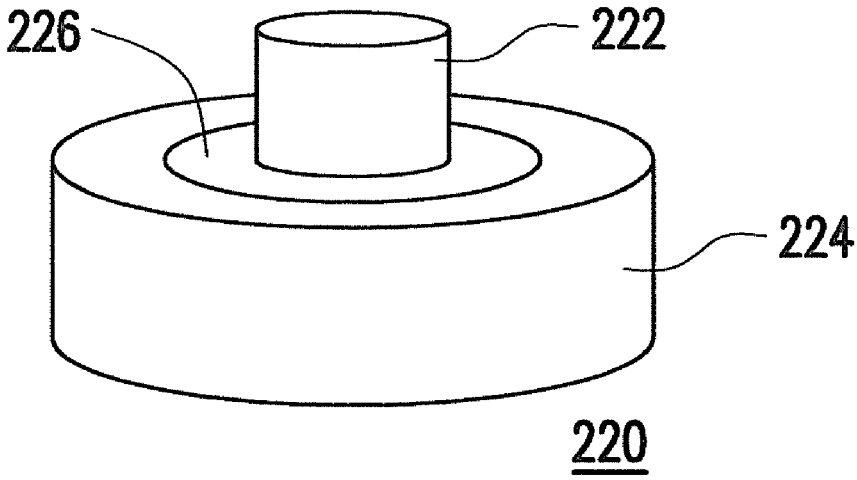

FIG. 11C and FIG. 11D are schematic diagrams illustrating a structure of a connecting structure according to another embodiment of the present invention. Referring to FIG. 11C and FIG. 11D, a difference between the present embodiment and the aforementioned embodiment is that a stacking direction of the connecting structure 220 is perpendicular to a stacking direction of the speaker units 210. In other words, the first conductive layer 222, the second conductive layer 224 and the first insulating layer 226 in the connecting structure 220 are stacked in a vertical direction, though it is different to an original horizontal stacking direction, the connecting structure 220 can still be connected to the speaker units 210. Moreover, to improve the electrical conduction effect, when the connecting structure 220 of the present embodiment is connected to the speaker units 210, a consecution arrangement as that of FIG. 9F can be applied to reduce an impedance of the electrical connection.

Figure 10A:
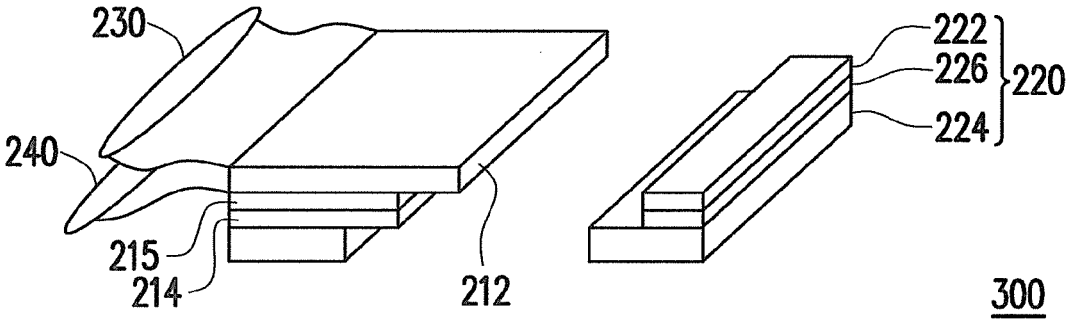
FIG. 10A is a schematic diagram illustrating an assembly structure of flat speaker according to another embodiment of the present invention.
Figure 10B:
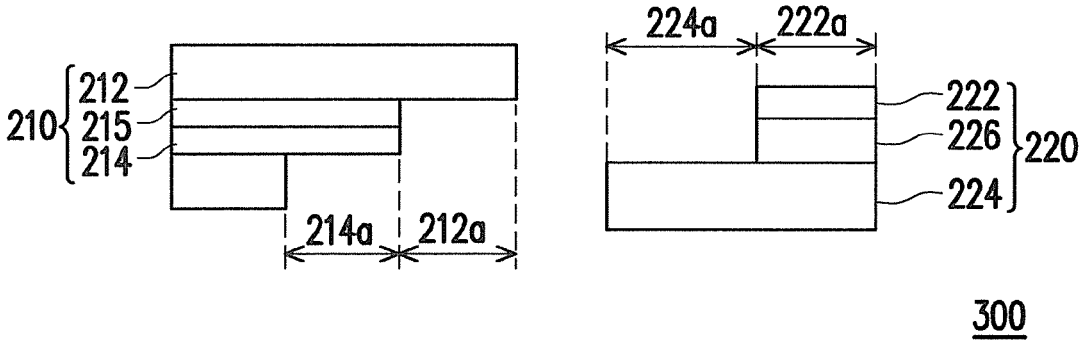
FIG. 10B is a cross-sectional exploded view of an assembly structure of flat speaker of FIG. 10A along an electrical conduction direction.

FIG. 10A is a schematic diagram illustrating an assembly structure of a flat speaker according to another embodiment of the present invention. FIG. 10B is a cross-sectional exploded view of the assembly structure of a flat speaker of FIG. 10A along an electrical conduction direction. Referring to FIG. 10A and FIG. 10B, the assembly structure 300 includes a speaker unit 210 and a connecting structure 220. The speaker unit 210 includes a first electrode 212, a second electrode 214 and a vibrating film 215. The connecting structure 220 includes a first conductive layer 222, a second conductive layer 224 and a first insulating layer 226, wherein the first insulating layer 226 is disposed between the first conductive layer 222 and the second conductive layer 224.

In the present embodiment, when the speaker unit 210 is assembled to the connecting structure 220, the first conductive layer 222 is electrically connected to the first electrode 212 of the speaker unit 210 through a contact area, wherein the first electrode 212 on the contact area has a first length 212*a* parallel to the contact area. Moreover, the first conductive layer 222 on the contact area has a third length 222*a* parallel to the contact area, wherein the third length 222*a* is less than or equal to the first length 212*a*.

On the other hand, the second conductive layer 224 is electrically connected to the second electrode 214 of the speaker unit 220 through a contact area, wherein the second electrode 214 on the contact area has a second length 214*a* parallel to the contact area. Moreover, the second conductive layer 224 on the contact area has a fourth length 224*a* parallel to the contact area, and a sum of the third length 222*a* and the fourth length 224*a* is less than or equal to a sum of the first length 212*a* and the second length 214*a*.

In other words, the contact area of the connecting structure 220 is less than or equal to the contact areas of the first electrode 212 and the second electrode 214, which means that the connecting structure 220 can be adjusted according to a size of the contact areas of the first electrode 212 and the second electrode 214, so that the connecting structure 220 can match a requirement of an appearance size of the speaker unit 210. In the present embodiment, the speaker unit can be used to margin the assembly structure 300 when the assembly structure 300 is assembled.

In the present embodiment, the assembly structure 300 further includes at least two signal input sources 230 and 240. The signal input sources 230 and 240 are electrically connected to the first electrode 212 and the second electrode 214, respectively, so as to input the source signals to the speaker unit 210. In another embodiment that is not illustrated, the signal input sources 230 and 240 can be electrically connected to the first conductive layer 222 and the second conductive layer 224, respectively, so that the source signals can be simultaneously input to the speaker unit 210 through the connecting structure 220.

In the present embodiment, a detailed structure of the speaker unit 210 is as that shown in FIG. 3 and FIG. 4, the connecting structure 220 is as that shown in FIG. 5 and FIG. 8, and matching of the speaker unit 210 and the connecting structure 220 is as that shown in FIG. 9A to FIG. 9G, so that detailed description thereof are not repeated.

Figure 12A:
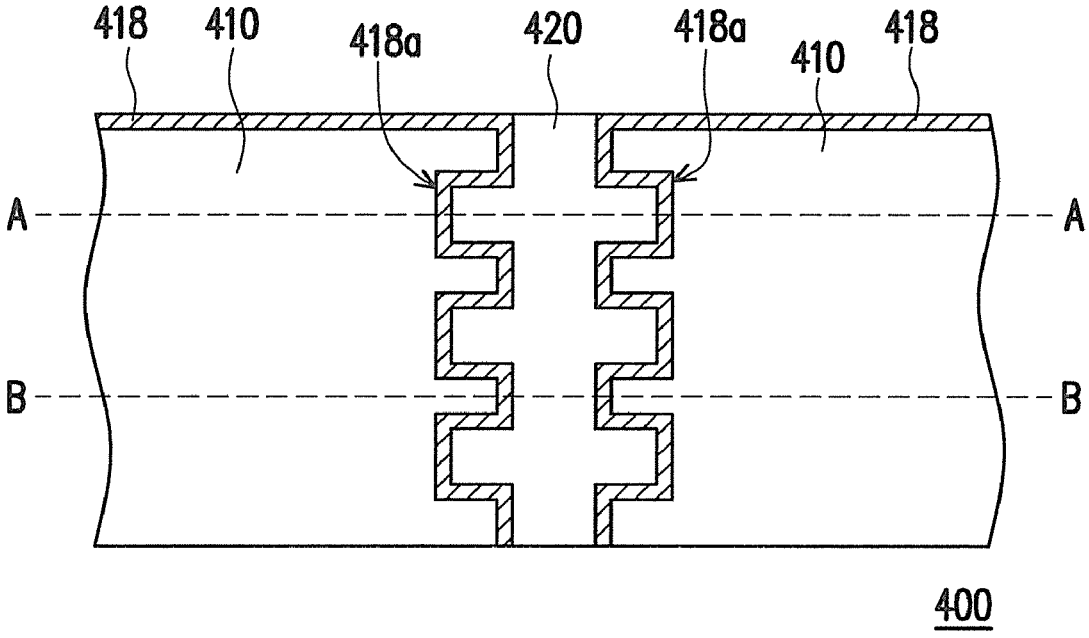
FIG. 12A is partial bottom view of an assembly structure of flat speaker according to still another embodiment of the present invention.
Figure 12B:
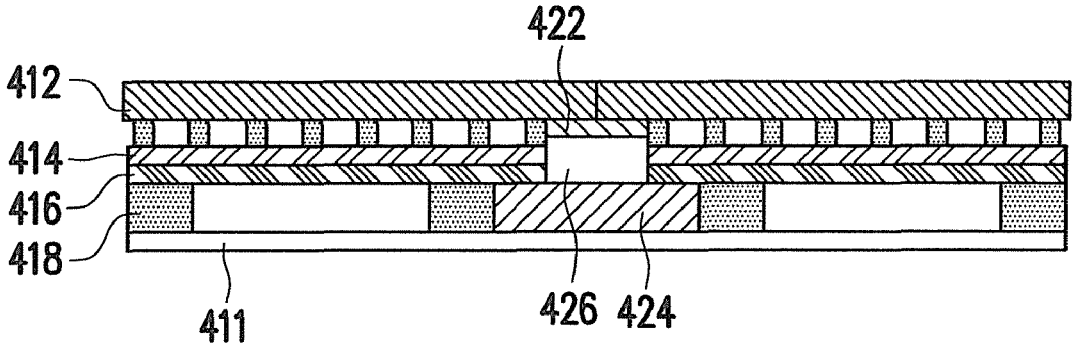
FIG. 12B is a cross-sectional view of an assembly structure of flat speaker of FIG. 12A cut along an A-A line.
Figure 12C:
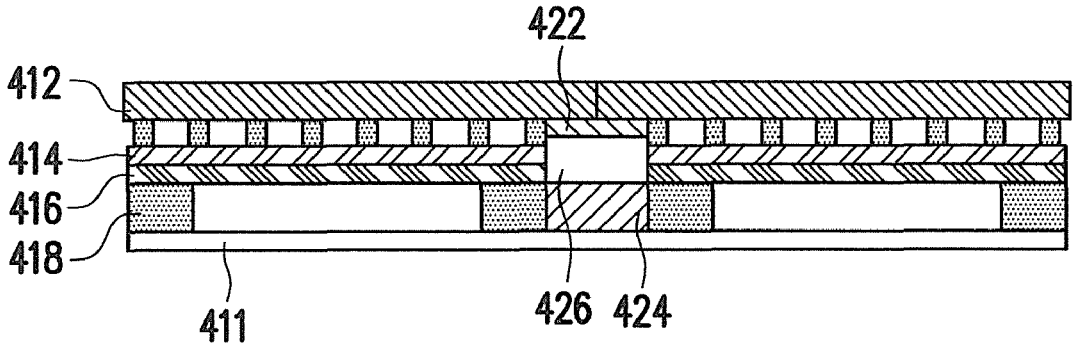
FIG. 12C is a cross-sectional view of an assembly structure of flat speaker of FIG. 12A cut along a B-B line.

FIG. 12A is partial bottom view of an assembly structure of a flat speaker according to still another embodiment of the present invention. FIG. 12B is a cross-sectional view of the assembly structure of a flat speaker of FIG. 12A cut along an A-A line. FIG. 12C is a cross-sectional view of the assembly structure of a flat speaker of FIG. 12A cut along a B-B line. Referring to FIG. 12A, FIG. 12B and FIG. 12C, in the present embodiment, the assembly structure 400 includes at least two speaker units 410 and at least a connecting structure 420. Each of the speaker units 410 includes a first electrode 412, a vibrating film 414, a second electrode 416 and an edge frame supporter 418, wherein the vibrating film 414 is stacked on the second electrode 416, and is located between the first electrode 412 and the second electrode 416. The edge frame supporter 418 is disposed around the speaker units 410, and is located on the second electrode 416 at a side apart from the vibrating film 414, which is used for supporting the speaker units 410 and forming an outline of the speaker units 410.

The connecting structure 420 is used for assembling the speaker units 410. The connecting structure 420 includes a first conductive layer 422, a second conductive layer 424 and an insulating layer 426. When the connecting structure 420 is assembled to the speaker units 410, length matching between the first electrode 412, the second electrode 416 and the first conductive layer 422, the second conductive layer 424 due to electrical connections there between is as that shown in FIG. 2B and FIG. 2C, and therefore detailed descriptions thereof are not repeated. Moreover, in the present embodiment, the assembly structure 400 also includes at least two signal input sources, and connection methods thereof are as that of the signal input sources 230 and 240 of FIG. 2A, by which the source signals can be respectively input to the speaker units 410 through the electrodes or the connecting structure. In addition, the connecting structure 420 can be the connecting structures shown in FIG. 5 to FIG. 8 and FIG. 11A to FIG. 11D, and matching of the speaker units 410 and the connecting structure 420 is as that shown in FIG. 9A to FIG. 9E, and detailed descriptions thereof are not repeated.

On the other hand, the speaker unit 410 further includes a chamber substrate 411 located on the second electrode 416 at a side apart from the vibrating film 414. However, different to the aforementioned embodiment, in the present embodiment, the edge frame supporter 418 is located between the second electrode 416 and the chamber substrate 411, and the edge frame supporter 418 has a dentation structure 418*a*. When a structure of the speaker unit 410 under the vibrating film 414 is shrunken inside to preserve a space for the connecting structure 420, the vibrating film 414 can still be stably supported based on the dentation structure 418*a* of the edge frame supporter 418.

Figure 13A:
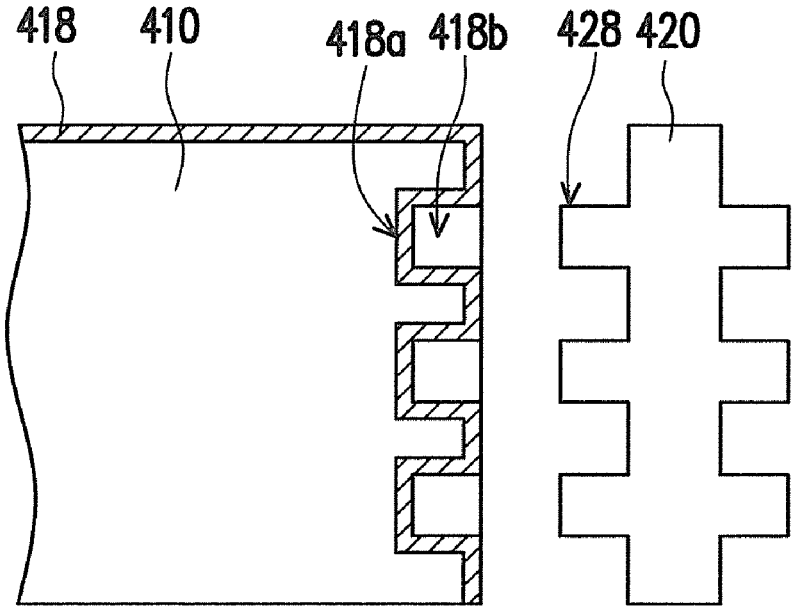
FIG. 13A is a partial exploded view of an assembly structure of flat speaker of FIG. 12A.
Figure 13B:
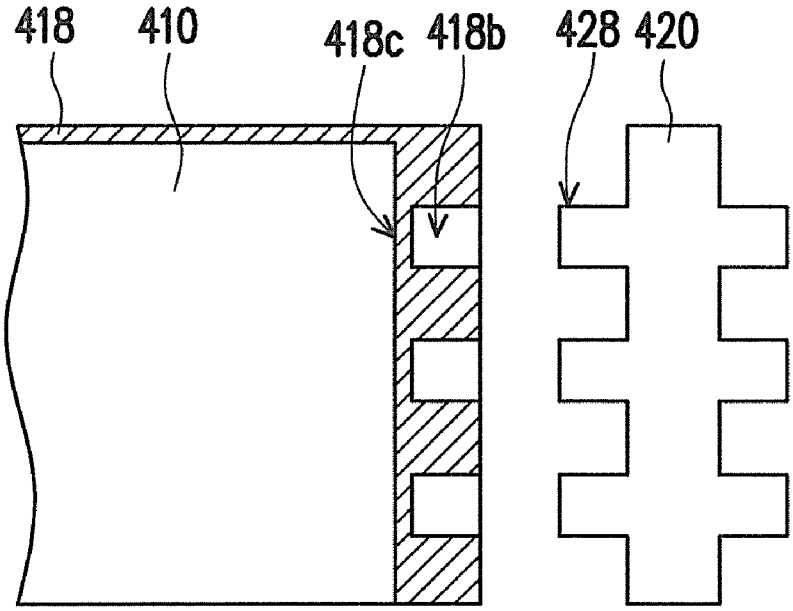
FIG. 13B is a partial exploded view of an assembly structure of flat speaker according to another embodiment of the present invention.

FIG. 13A is a partial exploded view of the assembly structure of a flat speaker of FIG. 12A. Referring to FIG. 13A, the edge frame supporter 418 has a plurality of indentations 418*b*, and the connecting structure 420 has a plurality of protrusions 428 engaging to the indentations 418*b*, by which the speaker units 410 can be connected through the connecting structure 420. FIG. 13B is a partial exploded view of an assembly structure of a flat speaker according to another embodiment of the present invention. Referring to FIG. 13B, different to the aforementioned embodiment, the edge frame supporter 418 has a dentation structure 418*c* different to that shown in FIG. 13A, and the connecting structure 420 also has a plurality of the protrusions 428 engaged to the indentations 418*b*, so as to connect the speaker units 410.

In another embodiment that is not illustrated, the dentation structure 418*a* of the edge frame supporter 418 is irregularly arranged, and spaces thereof can be adjusted according to a utilization or fabrication requirement. Namely, when the connecting structure 420 and the speaker units 410 are assembled, they can be aligned according to different spaces of the dentation structure 418*a*. Therefore, the dentation structure 418*a* or the protrusions 428 of the connecting structure 420 are not limited by the present invention, and any approach that can match and connect the connecting structure 420 to the speaker units 410 is considered to be within an application range of the present invention.

In one exemplary embodiment, the assembly structure of a flat speaker of the present invention has appearance characteristics of flexibility, lightness and slimness, and the flat speaker with different appearances can be implemented by changing the shape of the connecting structure. Moreover, since the speaker units and the corresponding connecting structure have characteristics of flexibility and none space-occupation, the assembly structure of a flat speaker is suitable for surfaces of various home furniture or surfaces of various buildings. In addition, the shapes and quantities of the speaker units and the connecting structure can be designed according to actual requirements, so that the assembly structure of a flat speaker of the present invention is easy to be installed and is convenient for utilization.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An assembly structure of a flat speaker, comprising:

at least two speaker units, each speaker unit comprising a first electrode, a vibrating film, and a second electrode, wherein the vibrating film is stacked on the second electrode, and is disposed between the first electrode and the second electrode; and at least a connecting structure, for assembling the speaker units, and the connecting structure comprising:

a first conductive layer, electrically connected to the first electrodes through a contact area, wherein the first electrode on the contact area has a first length parallel to the first contact area, and the first conductive layer on the first contact area has a third length parallel to the contact area;

a second conductive layer, electrically connected to the second electrodes through a second contact area, wherein the second electrode on the second contact area has a second length parallel to the contact area, and the second conductive layer on the second contact area has a fourth length and a fifth length respectively parallel to the second contact area, and the fourth and fifth lengths are less than or equal to the second length; and a first insulating layer, disposed between the first conductive layer and the second conductive layer, wherein when the speaker units are assembled through the connecting structure, the third length is less than or equal to a sum of the first lengths, and a sum of the third length, the fourth length, and the fifth length is less than or equal to a sum of the first lengths and the second lengths.

2. The assembly structure as claimed in claim 1, wherein the first lengths of the first speaker units are unnecessary to be mutually equal, and the second lengths are unnecessary to be mutually equal.

3. The assembly structure as claimed in claim 1 further comprising at least two signal input sources, and the signal input sources being used for inputting signals to the assembly structure of flat speaker through the connecting structure or the speaker unit.

4. The assembly structure as claimed in claim 1, wherein the speaker unit further comprises a chamber substrate located on the second electrode at a side apart from the vibrating film.

5. The assembly structure as claimed in claim 1, wherein the first electrode has a plurality of holes or stripes.

6. The assembly structure as claimed in claim 1, wherein the first electrode is formed by a metal material layer.

7. The assembly structure as claimed in claim 1, wherein the first electrode is formed by a polymer material or paper plated with a conductive material layer.

8. The assembly structure as claimed in claim 1, wherein the connecting structure further comprises a second insulating layer disposed on a surface apart from the first insulating layer, which is used for adjusting a height of the connecting structure.

9. The assembly structure as claimed in claim 1, wherein the contact areas of the speaker units and the connecting structure all have uneven structures.

10. The assembly structure as claimed in claim 1, wherein the connecting structure further comprises a conductive adhesive material disposed on surfaces of the first conductive layer and the second conductive layer, which is used for attaching and electrically connecting the first electrode and the second electrode.

11. The assembly structure as claimed in claim 9, wherein the connecting structure further comprises a non-conductive adhesive material, and based on a shrinking or a curing characteristic of the non-conductive adhesive material due to chemical reactions, protrusion parts of the uneven structures of the speaker units and the connecting structure are electrically connected.

12. The assembly structure as claimed in claim 1, wherein the connecting structure further comprises an adhesive material disposed on a surface of the connecting structure apart from the speaker units, which is used for attaching the connecting structure to surfaces of other objects.

13. The assembly structure as claimed in claim 1, wherein the connecting structure is selected according to appearances and quantities of the speaker units.

14. The assembly structure as claimed in claim 13, wherein the connecting structure has a long-bar shape, a cross shape, a turning shape, or a shape of dentations or an irregular curve, wherein the connecting structure is formed by a plurality of polygons, a plurality of circles, a plurality of ellipses or combinations thereof.

15. The assembly structure as claimed in claim 1, wherein the connecting structure further has a second protrusion located on the first conductive layer for connecting the first electrodes.

16. The assembly structure as claimed in claim 15, wherein the second protrusion is formed by a conductive material or an insulating material.

17. The assembly structure as claimed in claim 1, wherein a stacking direction of the connecting structure is perpendicular to a stacking direction of the speaker unit.

18. An assembly structure of a flat speaker, comprising:

at least a speaker unit, comprising a first electrode, a vibrating film, and a second electrode, wherein the vibrating film is stacked on the second electrode, and is located between the first electrode and the second electrode; and at least a connecting structure, for assembling the speaker unit, and the connecting structure comprising:

a first conductive layer, electrically connected to the first electrodes through a contact area, wherein the first electrode on the contact area has a first length parallel to the contact area, and the first conductive layer on the contact area has a third length parallel to the contact area, and the third length is less than or equal to the first length;

a second conductive layer, electrically connected to the second electrodes through a contact area, wherein the second electrode on the contact area has a second length parallel to the contact area, and the second conductive layer on the contact area has a fourth length parallel to the contact area, and the fourth length is less than or equal to the second length; and a first insulating layer, disposed between the first conductive layer and the second conductive layer, wherein when the speaker unit is assembled through the connecting structure, a sum of the third length and the fourth length is less than or equal to a sum of the first length and the second length.

19. The assembly structure as claimed in claim 18, wherein the first lengths of the first speaker units are unnecessary to be mutually equal, and the second lengths are unnecessary to be mutually equal.

20. The assembly structure as claimed in claim 18 further comprising at least two signal input sources, and the signal input sources being used for inputting signals to the assembly structure of flat speaker through the connecting structure or the speaker unit.

21. The assembly structure as claimed in claim 18, wherein the connecting structure further comprises a second insulating layer disposed on a surface apart from the first insulating layer, which is used for adjusting a height of the connecting structure.

22. The assembly structure as claimed in claim 18, wherein the contact areas of the flat speaker and the connecting structure all have uneven structures.

23. The assembly structure as claimed in claim 22, wherein the connecting structure further comprises a non-conductive adhesive material, and based on a shrinking or a curing characteristic of the non-conductive adhesive material due to chemical reactions, protrusion parts of the uneven structures of the flat speaker and the connecting structure are electrically connected.

24. The assembly structure as claimed in claim 18, wherein the connecting structure further comprises a conductive adhesive material disposed on surfaces of the first conductive layer and the second conductive layer, which is used for attaching and electrically connecting the first electrode and the second electrode.

25. The assembly structure as claimed in claim 18, wherein the connecting structure further comprises an adhesive material disposed on a surface of the connecting structure apart from the flat speaker, which is used for attaching the connecting structure to surfaces of other objects.

26. The assembly structure as claimed in claim 18, wherein the connecting structure is selected according to an appearance and a quantity of the speaker unit.

27. The assembly structure as claimed in claim 26, wherein the connecting structure has a long-bar shape, a cross shape, a turning shape, or a shape of dentations or an irregular curve, wherein the connecting structure is formed by a plurality of polygons, a plurality of circles, a plurality of ellipses or combinations thereof.

28. The assembly structure as claimed in claim 18, wherein a stacking direction of the connecting structure is perpendicular to a stacking direction of the speaker unit.

29. An assembly structure of a flat speaker, comprising:

at least two speaker units, each speaker unit comprising a first electrode, a vibrating film, a second electrode and an edge frame supporter, wherein the vibrating film is stacked on the second electrode, and is located between the first electrode and the second electrode, the edge frame supporter is disposed around the speaker unit and located on the second electrode at a side apart from the vibrating film, and is used for supporting the speaker unit and forming an outline of the speaker unit; and at least a connecting structure, for assembling the speaker units, and the connecting structure comprising:

a first conductive layer, electrically connected to the first electrodes through a contact area, wherein the first electrode on the contact area has a first length parallel to the contact area, and the first conductive layer on the contact area has a third length parallel to the contact area;

a second conductive layer, electrically connected to the second electrodes through a contact area, wherein the second electrode on the contact area has a second length parallel to the contact area, and the second conductive layer on the contact area has a fourth length and a fifth length respectively parallel to the contact area, and the fourth and fifth lengths are respectively less than or equal to the second length; and a first insulating layer, disposed between the first conductive layer and the second conductive layer, wherein when the speaker units are assembled through the connecting structure, the third length is less than or equal to a sum of the first lengths, and a sum of the third length, the fourth length, and the fifth length is less than or equal to a sum of the first lengths and the second lengths.

30. The assembly structure as claimed in claim 29, wherein the first lengths of the first speaker units are unnecessary to be mutually equal, and the second lengths are unnecessary to be mutually equal.

31. The assembly structure as claimed in claim 29, wherein the edge frame supporter has a dentation structure.

32. The assembly structure as claimed in claim 31, wherein spaces between the dentation structure are unnecessary to be equal.

33. The assembly structure as claimed in claim 31, wherein the edge frame supporter further has a plurality of indentations, and the connecting structure has a plurality first protrusions engaging to the indentations.

34. The assembly structure as claimed in claim 29, wherein the edge frame supporter further has a plurality of indentations, and the connecting structure has a plurality first protrusions engaging to the indentations.

35. The assembly structure as claimed in claim 29 further comprising at least two signal input sources, and the signal input sources being used for inputting signals to the assembly structure of flat speaker through the connecting structure or the speaker unit.

36. The assembly structure as claimed in claim 29, wherein the connecting structure further comprises a second insulating layer disposed on a surface apart from the first insulating layer, which is used for adjusting a height of the connecting structure.

37. The assembly structure as claimed in claim 29, wherein the contact areas of the speaker units and the connecting structure all have uneven structures.

38. The assembly structure as claimed in claim 37, wherein the connecting structure further comprises a non-conductive adhesive material, and based on a shrinking or a curing characteristic of the non-conductive adhesive material due to chemical reactions, protrusion parts of the uneven structures of the speaker units and the connecting structure are electrically connected.

39. The assembly structure as claimed in claim 29, wherein the connecting structure further comprises a conductive adhesive material disposed on surfaces of the first conductive layer and the second conductive layer, which is used for attaching and electrically connecting the first electrode and the second electrode.

40. The assembly structure as claimed in claim 29, wherein the connecting structure further comprises an adhesive material disposed on a surface of the connecting structure apart from the flat speaker, which is used for attaching the connecting structure to surfaces of other objects.

41. The assembly structure as claimed in claim 29, wherein the connecting structure is selected according to appearances and quantities of the speaker units.

42. The assembly structure as claimed in claim 41, wherein the connecting structure has a long-bar shape, a cross shape, a turning shape, or a shape of dentations or an irregular curve, wherein the connecting structure is formed by a plurality of polygons, a plurality of circles, a plurality of ellipses or combinations thereof.

43. The assembly structure as claimed in claim 29, wherein the connecting structure further has a second protrusion located on the first conductive layer for connecting the first electrodes.

44. The assembly structure as claimed in claim 43, wherein the second protrusion is formed by a conductive material or an insulating material.

45. The assembly structure as claimed in claim 29, wherein a stacking direction of the connecting structure is perpendicular to a stacking direction of the speaker unit.

* * * * *